US009096357B2

(12) United States Patent
Brausen

(10) Patent No.: US 9,096,357 B2
(45) Date of Patent: Aug. 4, 2015

(54) SELF-VENTILATING CONTAINER

(71) Applicant: Daniel John Brausen, Little Canada, MN (US)

(72) Inventor: Daniel John Brausen, Little Canada, MN (US)

( * ) Notice: Subject to any disclaimer, the term of this patent is extended or adjusted under 35 U.S.C. 154(b) by 53 days.

(21) Appl. No.: 14/087,189

(22) Filed: Nov. 22, 2013

(65) Prior Publication Data

US 2014/0144948 A1 May 29, 2014

Related U.S. Application Data

(60) Provisional application No. 61/729,812, filed on Nov. 26, 2012.

(51) Int. Cl.
*B67D 3/00* (2006.01)
*B65D 47/32* (2006.01)

(52) U.S. Cl.
CPC ..... *B65D 47/32* (2013.01)

(58) Field of Classification Search
CPC ..... F16K 24/04; F16K 24/06; B65D 47/06; B65D 47/12; B65D 47/32; B65D 51/16; B65D 51/1605; B65D 51/1611; B65D 2205/00; B65D 2205/02; B67D 7/005; B67D 2001/0815; B67D 2001/0817; Y10S 215/902; Y10S 220/27; Y10S 220/913
USPC ..... 222/468, 478, 479
See application file for complete search history.

(56) References Cited

U.S. PATENT DOCUMENTS

| | | | | | |
|---|---|---|---|---|---|
| 33,471 | A | * | 10/1861 | Anderson | 141/309 |
| 1,190,586 | A | * | 7/1916 | Robertson | 222/481.5 |
| 1,243,963 | A | * | 10/1917 | Moser | 215/386 |
| 2,847,042 | A | * | 8/1958 | Edelmann | 141/94 |
| 3,173,587 | A | | 3/1965 | Stearns | |
| 3,630,419 | A | | 12/1971 | Pierce | |
| 3,834,594 | A | * | 9/1974 | Schiemann | 222/479 |
| 3,858,766 | A | * | 1/1975 | Schiemann | 222/479 |
| 3,901,417 | A | * | 8/1975 | Schiemann | 222/479 |
| 4,120,414 | A | * | 10/1978 | Harrison et al. | 215/307 |
| 4,588,111 | A | * | 5/1986 | Hestehave | 222/479 |
| 4,597,513 | A | * | 7/1986 | Schiemann | 222/478 |
| 4,671,421 | A | * | 6/1987 | Reiber et al. | 215/228 |
| 4,696,416 | A | * | 9/1987 | Muckenfuhs et al. | 222/109 |
| 4,917,268 | A | * | 4/1990 | Campbell et al. | 222/109 |
| 5,002,209 | A | * | 3/1991 | Goodall | 222/479 |
| 5,108,009 | A | * | 4/1992 | Davidson et al. | 222/109 |
| 5,538,165 | A | * | 7/1996 | Frohn | 222/479 |
| 5,711,355 | A | * | 1/1998 | Kowalczyk | 141/382 |
| 5,746,358 | A | | 5/1998 | Crosby | |
| 7,959,044 | B1 | * | 6/2011 | Christian et al. | 222/468 |
| 2001/0054628 | A1 | * | 12/2001 | Harbaugh et al. | 222/479 |
| 2004/0035894 | A1 | * | 2/2004 | Gobbini et al. | 222/479 |
| 2004/0108340 | A1 | * | 6/2004 | Witt | 222/464.3 |
| 2008/0210658 | A1 | * | 9/2008 | Jo | 215/379 |

(Continued)

*Primary Examiner* — Patrick M Buechner

(74) *Attorney, Agent, or Firm* — Daniel Boudwin; Global Intellectual Property Agency LLC

(57) ABSTRACT

A self-ventilating liquid container that includes a pair of venting channels disposed through the container's spout. A second venting channel of the pair provides increased performance, including improved flow rate and less turbulent liquid flow, because the second venting channel allows more air to flow into the internal volume of the container while providing airflow to different areas within the container. The positioning of a first venting channel and a second venting channel within the container interior and in different locations therein reduces any chance of a vacuum forming within the container during dispensation.

4 Claims, 4 Drawing Sheets

(56) References Cited

U.S. PATENT DOCUMENTS

| | | | | |
|---|---|---|---|---|
| 2011/0132939 | A1* | 6/2011 | Brooks | 222/481 |
| 2011/0186535 | A1* | 8/2011 | Meager | 215/40 |
| 2011/0210092 | A1* | 9/2011 | Meager | 215/40 |
| 2012/0193318 | A1* | 8/2012 | Meager | 215/40 |
| 2012/0280001 | A1* | 11/2012 | Leadbeater | 222/481.5 |
| 2013/0334161 | A1* | 12/2013 | Meager | 215/40 |
| 2014/0144948 | A1* | 5/2014 | Brausen | 222/481 |

* cited by examiner

SELF-VENTILATING CONTAINER

CROSS REFERENCE TO RELATED APPLICATION

This application claims the benefit of U.S. Provisional Application No. 61/729,812 filed on Nov. 26, 2012. The above identified patent application is herein incorporated by reference in its entirety to provide continuity of disclosure.

BACKGROUND OF THE INVENTION

1. Field of the Invention

The present invention relates to vented containers. More specifically, the present invention relates to containers that are designed with a venting means therein to allow air to enter thereinto for smoother and more controlled pouring of the liquid contents from the spout thereof.

Pouring liquid from a container that lacks a secondary venting hole can result in an erratic, messy pour because as liquid is emptied from the container, a vacuum is created. This vacuum creates a low-pressure environment that sucks air into the container to fill the void through the only available route: the spout of the container through which the liquid is currently being poured. The in-rushing air drawn through the same aperture from which the liquid is being poured creates a sporadic, interrupted flow as the force of the air being drawn in and the force of the liquid being poured out counteract each other. As a result, the air does not enter the container in a steady manner, but instead is intermittently sucked into the container, which creates pulsation in the liquid flowing from the container. As more and more pulses are created in the outflowing liquid, the liquid flow out of the container becomes increasingly more sporadic and less controlled. This sporadic flow of liquid out of enclosed containers is frustrating because it can lead to spillage if one is not careful enough.

Present devices attempt to address the issue with sporadic liquid flow out of containers by providing either a venting cap or a venting channel extending through the spout of the container. A single venting channel improves the pouring performance of the liquid containers, but it is still not an ideal container. Such venting channels are generally small and narrow, limiting the amount of air that can flow therethrough. The limited airflow through the venting channel results in the need for air to be sucked through the portion of the spout from which liquid exits the container, failing to solve the problem that the venting channels seek to solve.

The present invention provides a liquid container in a variety of configurations and types that has dual venting channels that both increase the rate of airflow into the internal volume of the container and deliver air to different areas within the container, ensuring that a vacuum will not form and create uneven flow in the liquid exiting the container. The increased airflow rate also increases the liquid pouring rate because more air entering the container allows more liquid to leave therefrom. The dual venting channels prevent chaotic liquid flow because they deliver inflowing air to different locations within the container, ensuring that the container is filled with air in a smooth manner.

2. Description of the Prior Art

Devices have been disclosed in the prior art that relate to ventilating containers and spouts. These include devices that have been patented and published in patent application publications. These devices generally relate to containers that have a single venting tube through the spout. The following is a list of devices deemed most relevant to the present disclosure, which are herein described for the purposes of highlighting and differentiating the unique aspects of the present invention, and further highlighting the drawbacks existing in the prior art.

One such device is U.S. Pat. No. 3,173,587 to Stearns, which discloses a retractable vented pouring spout attachment for mounting within the neck of a fluid container. The retractable spout has a vented breather passage formed within the spout that runs along the interior wall of the spout and across the top wall of the container. This vented breather passage allows air to enter the upper regions of the container without interfering the flow of the liquid through the spout. The present invention comprises a pair of venting tubes, rather than a single venting tube as with Stearns, to ensure that there is a steady supply for air flowing to vacate regions of the container while the user is pouring liquid therefrom.

Another such device is U.S. Pat. No. 3,630,419 to Pierce, which discloses a metal pour dispenser for bottles that has an air tube extending into the internal volume of the attached bottle. As with Stearns, the Pierce device comprises only a single venting tube, whereas the present invention comprises a pair of venting tubes extending to different areas of the internal volume of the container. Furthermore, the present invention comprises an integral container and spout construction wherein the vent tubes are molded into the walls of the container and do not merely drop into the internal volume of the container from the spout.

U.S. Pat. No. 3,901,417 to Schiemann, U.S. Pat. No. 4,588,111 to Hestehave, and U.S. Pat. No. 5,746,358 to Crosby all disclose a spout for venting fuel containers that has a single venting tube that is attached to the spout and runs into the internal volume of the container. The present invention comprises a container and spout construction that has a pair of venting tubes, one of which that extends to an upper rear portion of the container and another that extends to a lower rear portion of the container. This dual venting tube construction ensures a steady flow of air to areas of the container that are vacated as an increasing amount of liquid is poured from the container. A single venting tube may not adequately supply air to the internal volume of the container to ensure steady flow from the spout.

The present invention comprises a new and novel container and spout construction that utilizes a pair of venting tubes, as opposed to traditional designs that utilize a single venting tube, for ensuring proper flow of air into a pouring liquid container. The internal end of the second venting tube is exposed as liquid levels decrease due to liquid being poured out of the container, thereby providing a direct path for air to reach newly exposed regions of the container. It substantially diverges in design elements from the prior art and consequently it is clear that there is a need in the art for an improvement to existing vented liquid container devices. In this regard the instant invention substantially fulfills these needs.

SUMMARY OF THE INVENTION

In view of the foregoing disadvantages inherent in the known types of vented liquid containers now present in the prior art, the present invention provides a new vented liquid container wherein the same can be utilized for providing convenience for the user when dispensing liquid.

It is therefore an object of the present invention to provide a new and improved vented liquid container device that has all of the advantages of the prior art and none of the disadvantages.

It is another object of the present invention to provide a vented liquid container device that permits steady, smooth flow of liquid out of the container through the spout.

Another object of the present invention is to provide a vented liquid container device that provides a suitable barrier while not in use to prevent internal vapors within the container from escaping into the surrounding atmosphere, as required by most flammable or hazardous material containers.

Yet another object of the present invention is to provide a vented liquid container device that provides steady, even flow of liquid from the container.

Yet another object of the present invention is to provide a vented liquid container device that provides increased airflow to regions of the liquid container that are vacated as liquid is poured from the container.

Yet another object of the present invention is to provide a vented liquid container device that is available in a wide range of types, sizes, and configurations of liquid containers.

Still yet another object of the present invention is to provide a vented liquid container device that permits smooth flow of the liquid from the container even when the container is upended and one of the venting tubes is submerged.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
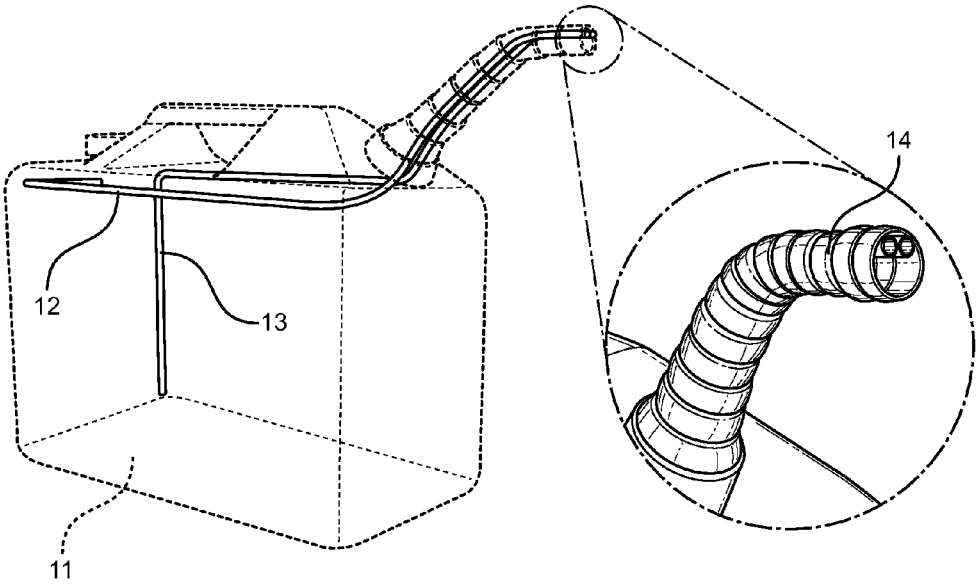
FIG. 1 shows a perspective view of an embodiment of the present invention with a call out showing the opening of the spout of the device.

Reference is made herein to the attached drawings. Like reference numerals are used throughout the drawings to depict like or similar elements of the vented liquid container. For the purposes of presenting a brief and clear description of the present invention, the preferred embodiment will be discussed as used for smoothly and evenly pouring liquid from the liquid container. The figures are intended for representative purposes only and should not be considered to be limiting in any respect.

The present invention generally consists of a liquid container, a spout, and a pair of integral venting tubes extending from the discharge end of the spout and extending therethrough and across the internal walls of the liquid container. Each of the venting tubes terminates at a different location within the internal volume of the liquid container. Generally, one of the venting tubes terminates at the upper rear portion of the internal volume of the liquid container and the other venting tube terminates at the lower rear portion of the internal volume. The venting tubes are designed such that one of the venting tubes is exposed merely by initially pouring liquid from the container and the second venting tube is gradually exposed as the liquid level lowers as liquid is poured form the container. No claim is made as to the specific shape, size, type, or configuration of the container as the dual venting tube system is designed to work with a wide variety of types of containers. All types of liquid containers require venting in order to pour smoothly and the dual venting tube system provides the smoothest and most complete access of air to the vacated regions of the liquid container.

Figure 2:
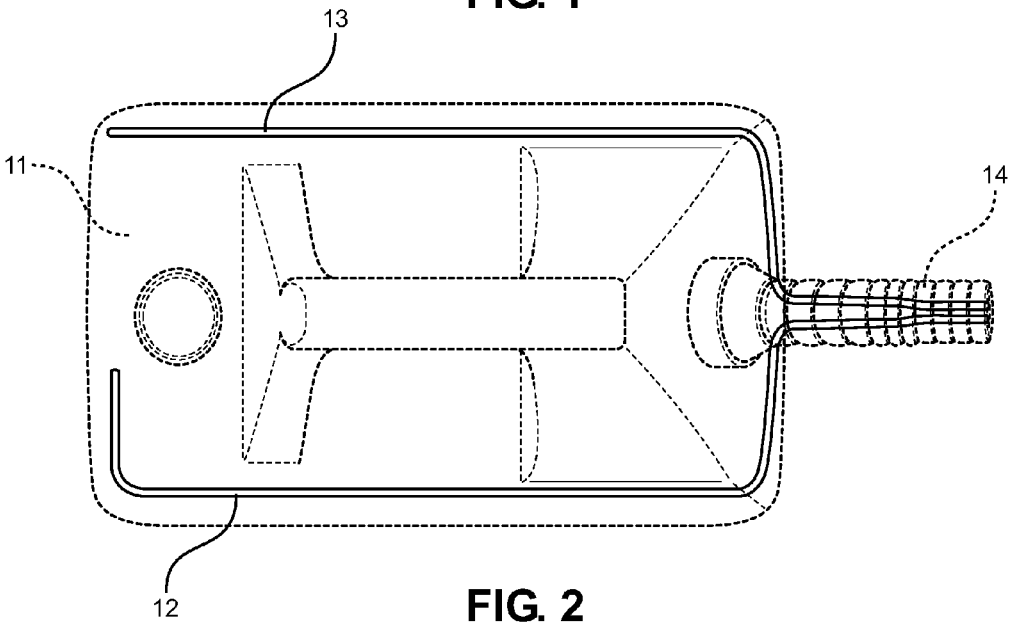
FIG. 2 shows a top-down view of an embodiment of the present invention.

Referring now to FIGS. 1 and 2, there are shown a perspective view of an embodiment of the present invention with a call out showing the opening of the spout and an overhead view of the present invention. The depicted embodiment of the present invention comprises a generically-shaped gas canister, but no claim is made as to the specific configuration or type of liquid container. The embodiment depicted is merely provided as an example of a potential type of liquid container for which the present dual venting channels can be applied. The liquid container could include any type of liquid container.

The present self-ventilating container comprises a liquid container body 11, a spout 14, a first venting tube 12, and a second venting tube 13. No claim is made as to the exact layout of the venting tubes 12, 13, except that the venting tubes 12, 13 are designed such that they are successively exposed as liquid is emptied from the container. The venting tubes 12, 13 each have a first open end that is flush with the pouring or discharge end of the spout 14 and a second open end that terminates at a location within the internal volume of the container. The venting tubes 12, 13 extend from the first open end through the spout 14, along the spout's 14 upper wall, and then along the inner wall of the container through the internal volume of the container until they terminate at their second ends near the general rear portion of the container. The venting tubes 12, 13 form a continuous elongated, uninterrupted channel between their first and second ends with a constant diameter.

The first venting tube 12 extends to the rear portion of the container such that it is generally exposed first as the container's liquid level drops as liquid is poured out of the container. The second venting tube 13 also extends to the rear portion of the container, but is configured such that it is exposed second as the container's liquid level drops. The two venting tubes work in concert to ensure that there is a steady flow of air to all areas of the internal volume of the container, without any interruptions. In containers having only a single venting tube, as the water level drops the single venting tube may be insufficient to send air to all areas of the internal volume of the container because the movement of the liquid may create areas of temporary vacuum as the liquid sloshes and moves within the container. A second venting tube helps to ensure that air will be continuously supplied, despite the movement of the liquid within the internal volume of the container.

In the depicted embodiment, the first venting tube 12 extends to the rear, upper portion of the container and the second venting tube 13 extends to the lower, rear portion of the container. The first venting tube 12 is exposed first because the initial tilt of the gas canister is sufficient to expose it. As the liquid level drops within the container, the second venting tube 13 is gradually exposed until its second end is no longer covered with liquid, thereby allowing air to flow therethrough. The second venting tube 13 extends to a more distal region of the gas container compared to the first venting tube 12 to ensure that air is more evenly supplied throughout the internal volume of the container. If air was only supplied through the first venting tube 12, then it may not evenly disperse throughout the internal volume.

Figure 3:
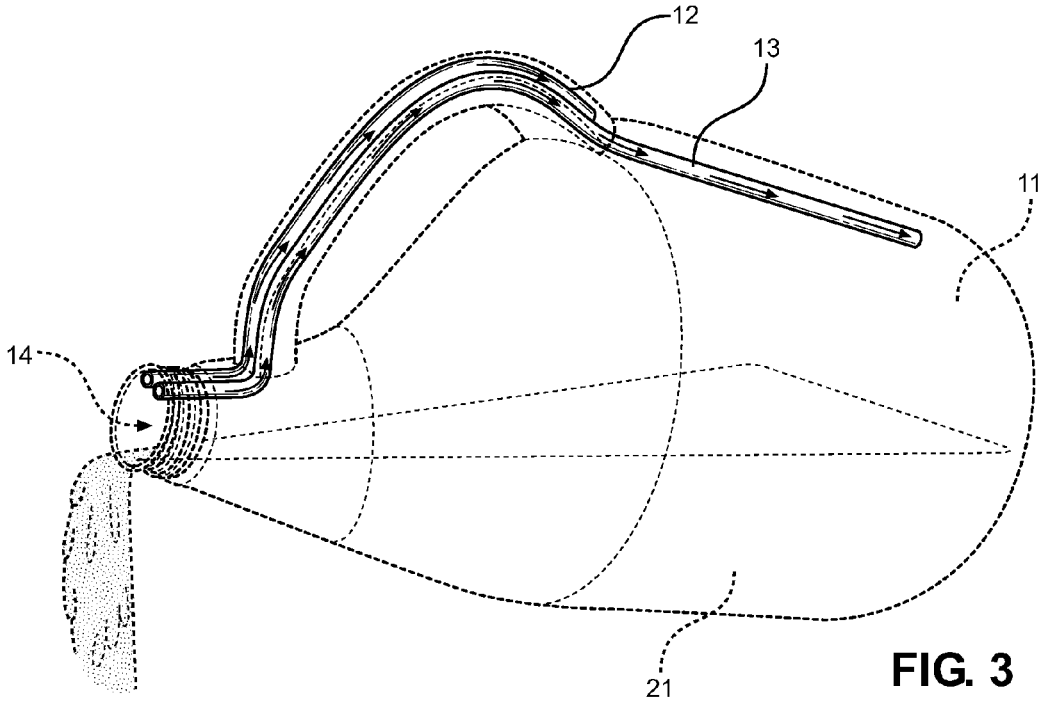
FIG. 3 shows a perspective view of an alternate embodiment of the present invention with liquid pouring out of the container.
Figure 4:
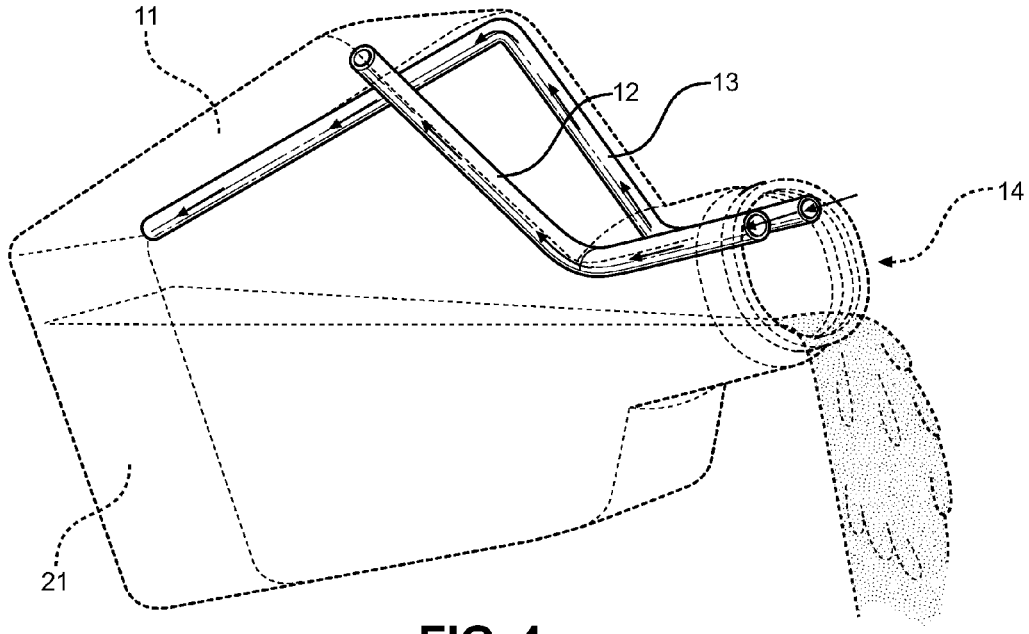
FIG. 4 shows a perspective view of another alternate embodiment of the present invention with liquid pouring out of the container.

Referring now to FIGS. 3 and 4, there are shown perspective views of alternative embodiments of the present invention. No claim is made as to the exact configuration or type of container used with the present invention because all types of containers from which liquid 21 is poured would benefit from venting. Although no claim is made as to the exact location of the venting tubes 12, 13 because the configuration of the liquid container is highly variable, the first venting tube 12 is configured such that its second end is exposed initially when the user begins pouring liquid 21 out of the container and the second venting tube 13 is configured such that its second end is exposed as the liquid 21 level within the container gradually drops.

Figure 5:
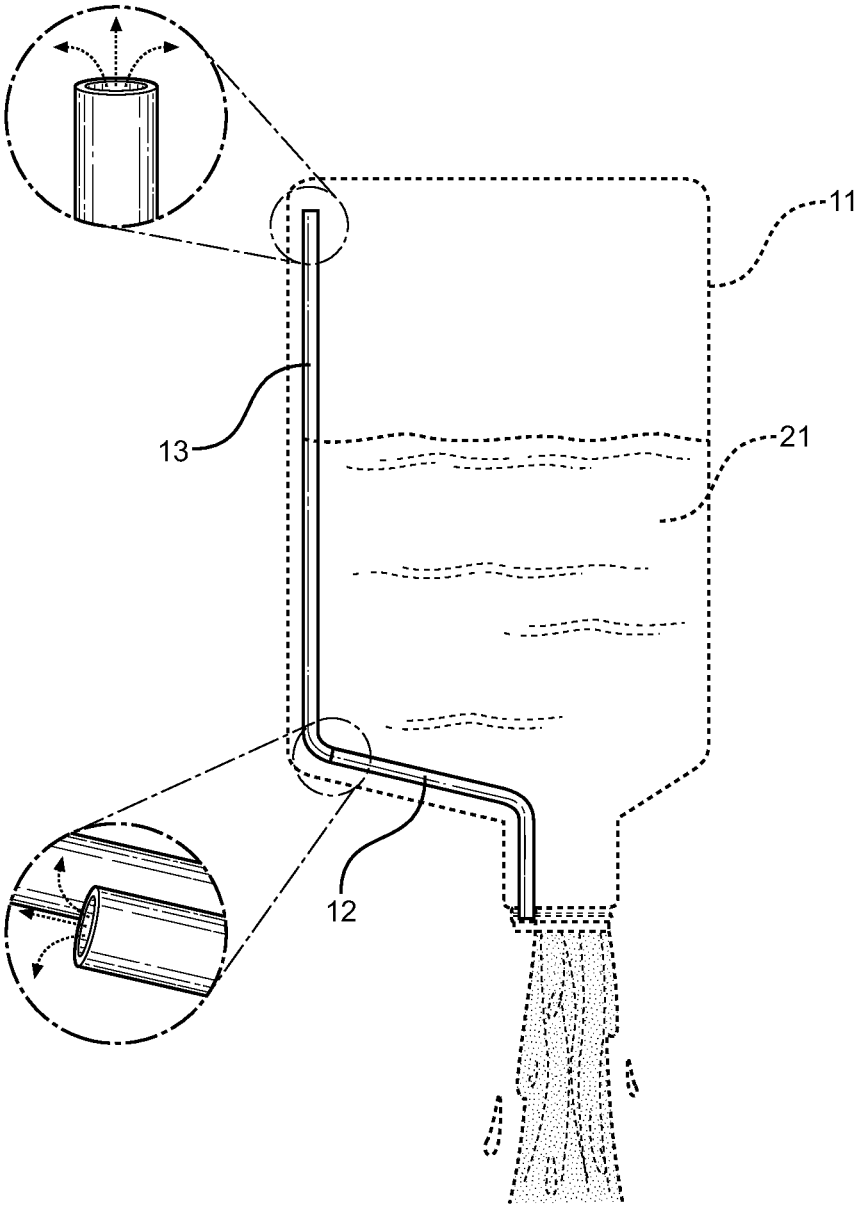
FIG. 5 shows a perspective view of an alternate embodiment of the present invention upended, with liquid flowing out of the container, and a call out for the terminal portions of each of the venting tubes.

Referring now to FIG. 5, there is shown a perspective view of an alternate embodiment of the present invention upended, with water pouring out of the container, and a call out for each of the terminal ends of the venting tubes. When the container body 11 is completely upended, allowing liquid 21 contained therein to pour from the container 11, the present invention could not vent without the presence of the second venting tube 13. Prior art containers having a single internal venting channel are unable to vent when the container is oriented in certain ways to pour liquid therefrom, because the sole venting tube is covered by the liquid 21 level. The present invention, however, provides a secondary venting tube that permits the device to vent when the other venting tube is covered by liquid 21, thereby ensuring stable, smooth flow of liquid, regardless of the orientation of the device.

Figure 6:
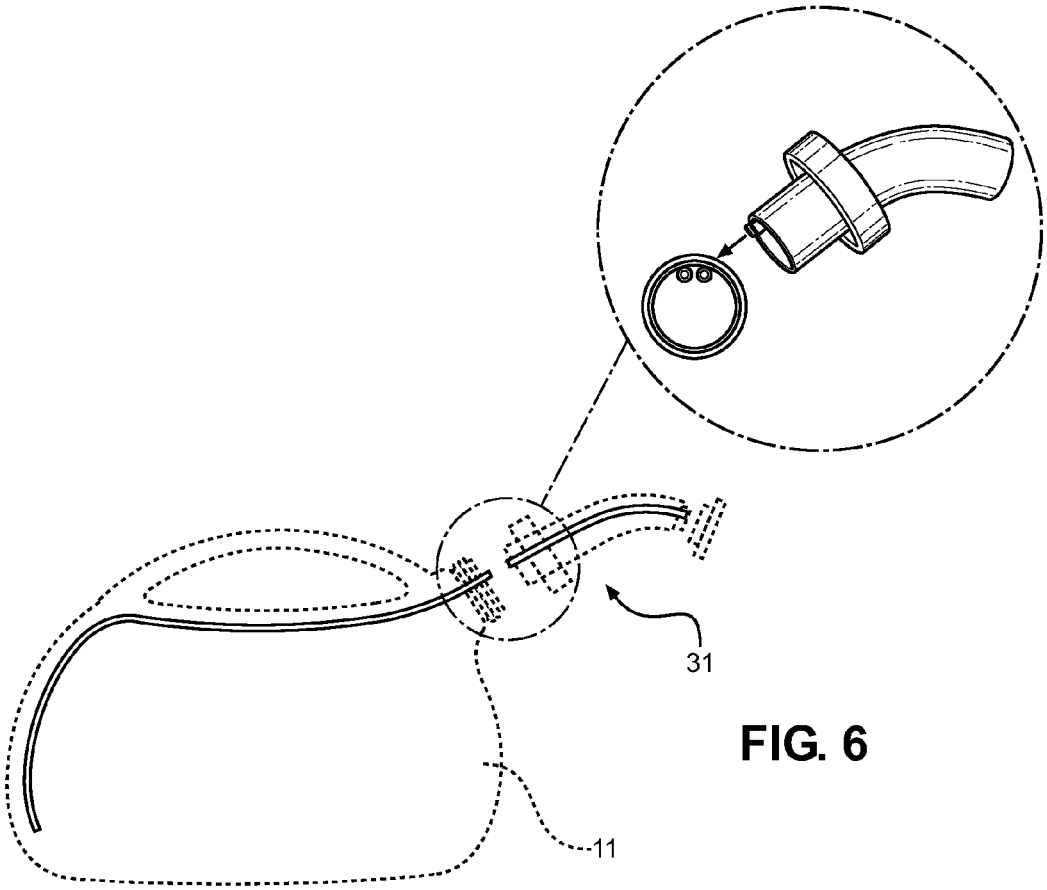
FIG. 6 shows an alternate embodiment of the present invention having a detachable spout with a call out showing the connection between the container and the spout.

Referring now to FIG. 6, there is shown a perspective view of an alternate embodiment of the present invention having a detachable spout and a call out showing the connection between the liquid container and the spout. In this alternate embodiment, the spout 31 is removable from the container body 11, allowing the present invention to be more easily filled and also aiding in storage of the device when the container is empty. The removable spout 31 connects to the container body 11 via an externally threaded portion extending from the container body 11 and a corresponding internally threaded portion on the removable spout 31. The venting tubes are adapted such that when the removable spout 31 is properly affixed in place, the portions of the venting tubes internal to the container body 11 and the portions extending through the spout 31 align so that liquid can flow therethrough and the two separate portions form a continuous venting tube.

In use, an individual pours the present self-ventilating container in the same way he or she would normally pour liquid out of a container. As liquid is poured out of the container, air flows first through the first venting tube and then through both the first and the second venting tube. This airflow both increases the flow rate of the liquid exiting the container and helps to ensure that there will be even flow of liquid from the container because it reduces the chance that a vacuum will form, which in turn creates a pulsation in the outflowing liquid as air is sucked through the liquid discharge end of the spout to fill the low pressure vacuum within the container. The present invention allows individuals to complete their tasks quicker and more efficiently and also reduces the chance of wasted liquid from spillage caused by chaotic liquid outflow.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A liquid container, comprising:

a plurality of sidewalls defining an internal volume;

a spout comprising a discharge end;

a first vent tube extending from said discharge end through said spout and along at least one of said sidewalls into an upper portion of said internal volume;

wherein the first vent tube is adapted to allow air to flow therethrough into said internal volume;

a second vent tube extending from said discharge end through said spout and along at least one of said sidewalls into a lower portion of said internal volume;

wherein the second vent tube is adapted to allow air to flow therethrough into said internal volume.

2. The liquid container of claim 1, wherein the liquid container comprises a gasoline canister.

3. A liquid container, comprising:

a plurality of sidewalls defining an internal volume;

a removable spout comprising a discharge end and an attachment end;

a first spout vent tube extending from said discharge end through said spout and terminating at said attachment end;

a first internal vent tube extending from said attachment end and extending along at least one of said sidewalls into an upper portion of said internal volume;

the first internal vent tube adapted to allow air to flow therethrough into said internal volume;

wherein the first internal vent tube and the first spout vent tube are configured to align such that they are in fluid communication when the removable spout is affixed to the liquid container;

a second spout vent tube extending from said discharge end through said spout and terminating at said attachment end;

a second internal vent tube extending from said attachment end and extending along at least one of said sidewalls into an upper portion of said internal volume;

the second internal vent tube adapted to allow air to flow therethrough into said internal volume;

wherein the second internal vent tube and the second spout vent tube are configured to align such that they are in fluid communication when the removable spout is affixed to the liquid container.

4. The liquid container of claim 3, wherein the liquid container comprises a gasoline canister.

* * * * *